US009345276B2

(12) United States Patent
Turkbas

(10) Patent No.: US 9,345,276 B2
(45) Date of Patent: May 24, 2016

(54) CLOTHING ARTICLE WITH PROTECTIVE CUP

(71) Applicant: Shock Doctor Inc., Minnetonka, MN (US)

(72) Inventor: Jay Turkbas, Orono, MN (US)

(73) Assignee: Shock Doctor, Inc., Minnetonka, MN (US)

( * ) Notice: Subject to any disclaimer, the term of this patent is extended or adjusted under 35 U.S.C. 154(b) by 218 days.

(21) Appl. No.: 14/209,870

(22) Filed: Mar. 13, 2014

(65) Prior Publication Data

US 2014/0276325 A1 Sep. 18, 2014

Related U.S. Application Data

(60) Provisional application No. 61/780,070, filed on Mar. 13, 2013.

(51) Int. Cl.
*A61F 13/00* (2006.01)
*A41D 13/05* (2006.01)
*A63B 71/12* (2006.01)

(52) U.S. Cl.
CPC ..... *A41D 13/0525* (2013.01); *A63B 71/1216* (2013.01); *A63B 2209/10* (2013.01)

(58) Field of Classification Search
CPC ..... A23F 3/18; A23F 5/262; A47J 31/0673; A47J 31/407; A47J 31/4492; A47J 31/46; A47J 36/2461; A47J 41/0061; A47J 41/0066; A47G 19/2288; A47G 19/2272; A47G 23/0216; A63B 71/1216; A63B 2209/10; A63B 71/12; A63B 2071/1233; A63B 2071/1241; A63B 2071/125; A63B 2208/12; A63B 2209/00; A63B 71/1225; A41B 9/02; A41B 2400/34; A41B 2400/38; A41B 9/004
USPC ..... 602/72; 128/845; 2/403
See application file for complete search history.

(56) References Cited

U.S. PATENT DOCUMENTS

| | | | |
|---|---|---|---|
| 756,666 | A | 4/1904 | Lustig |
| 849,471 | A | 4/1907 | Gamble |
| 903,472 | A | 11/1908 | Huddleston |
| 1,146,264 | A | 7/1915 | Kelly |
| 1,250,407 | A | 12/1917 | Woods |
| 1,477,565 | A | 12/1923 | Jenkins |
| 1,492,504 | A | 4/1924 | Blume |
| 1,688,676 | A | 10/1928 | Whitley |
| 1,720,439 | A | 7/1929 | Richardson |
| 1,830,572 | A | 11/1931 | Taylor |
| 1,866,220 | A | 7/1932 | Norton |
| 1,919,299 | A | 7/1933 | Levin |
| 1,990,403 | A | 2/1935 | Davitt |
| 2,255,931 | A | 9/1941 | Kloster |

(Continued)

FOREIGN PATENT DOCUMENTS

CA 1290098 E 10/1991

OTHER PUBLICATIONS

International Search Report and Written Opinion issued in PCT/US2014/26527, mailed Jul. 28, 2014, 13 pages.

(Continued)

*Primary Examiner* — Michael Brown
(74) *Attorney, Agent, or Firm* — Faegre Baker Daniels, LLP

(57) ABSTRACT

An article of clothing including a protective cup for protecting the groin area of a user. The article includes an upper portion having a front and a rear, and an interior and an exterior, for receiving the waist of the user. A cup sleeve having an apical portion is disposed in the interior of the upper portion while partially secured to the front of the upper portion with the apical portion extending free from the front of the upper portion. A securing member optionally extends from the apical portion to the rear of the upper portion.

14 Claims, 7 Drawing Sheets

(56) References Cited

U.S. PATENT DOCUMENTS

| | | | | |
|---|---|---|---|---|
| 2,283,684 | A | 5/1942 | Matthews | |
| 2,444,294 | A | 6/1948 | Jones et al. | |
| 2,521,039 | A | 9/1950 | Carpenter | |
| 2,522,375 | A | 9/1950 | Jones et al. | |
| 2,700,971 | A | 2/1955 | Mestel | |
| 2,713,340 | A | 7/1955 | Meminger | |
| 2,827,899 | A | 3/1958 | Altieri | |
| 2,854,973 | A | 10/1958 | Jackson | |
| 3,089,487 | A | 5/1963 | Enicks et al. | |
| 3,103,217 | A | 9/1963 | Butler et al. | |
| 3,176,686 | A | 4/1965 | Barnes | |
| 3,229,692 | A | 1/1966 | Creed | |
| 3,333,582 | A | 8/1967 | Cathcart | |
| D212,848 | S | 12/1968 | Westlund et al. | |
| 3,505,995 | A | 4/1970 | Greenberg | |
| 3,782,375 | A | 1/1974 | Donars | |
| 3,787,892 | A | 1/1974 | Quinn | |
| 3,788,314 | A * | 1/1974 | Noreen | A41D 1/08 2/466 |
| 3,797,501 | A | 3/1974 | Di Tullio | |
| RE28,667 | E | 12/1975 | Gores | |
| D246,011 | S | 10/1977 | Eckman | |
| 4,134,400 | A | 1/1979 | DiMatteo | |
| D252,116 | S | 6/1979 | DiMatteo | |
| 4,257,414 | A | 3/1981 | Gamm et al. | |
| 4,285,069 | A | 8/1981 | Hall | |
| 4,453,541 | A | 6/1984 | Castelli et al. | |
| 4,471,772 | A | 9/1984 | Miller, Jr. | |
| 4,484,360 | A | 11/1984 | Leighton et al. | |
| 4,568,280 | A | 2/1986 | Ahlin | |
| 4,587,675 | A | 5/1986 | Prouty | |
| 4,619,055 | A | 10/1986 | Davidson | |
| 4,660,554 | A | 4/1987 | Wright | |
| 4,698,847 | A | 10/1987 | Yoshihara | |
| D294,075 | S | 2/1988 | Bernstein | |
| 4,811,427 | A | 3/1989 | Regan | |
| 4,870,958 | A | 10/1989 | Webster | |
| 4,922,899 | A | 5/1990 | Graff et al. | |
| 4,967,768 | A | 11/1990 | Tatro | |
| 4,977,905 | A | 12/1990 | Kittelsen et al. | |
| 4,989,594 | A | 2/1991 | Doherty et al. | |
| 5,020,547 | A | 6/1991 | Strock | |
| 5,063,940 | A | 11/1991 | Adell et al. | |
| 5,117,816 | A | 6/1992 | Shapiro et al. | |
| D328,494 | S | 8/1992 | Schwendeman et al. | |
| 5,165,424 | A | 11/1992 | Silverman | |
| 5,239,706 | A | 8/1993 | Stevenson | |
| 5,274,854 | A * | 1/1994 | Wenner | A41B 9/02 2/403 |
| 5,277,203 | A | 1/1994 | Hays | |
| 5,293,880 | A | 3/1994 | Levitt | |
| 5,301,370 | A | 4/1994 | Henson | |
| 5,405,312 | A | 4/1995 | Jacobs | |
| 5,406,963 | A | 4/1995 | Adell | |
| D364,262 | S | 11/1995 | Magidson et al. | |
| 5,479,942 | A | 1/1996 | DiMatteo | |
| 5,499,404 | A | 3/1996 | Marchiorello | |
| 5,557,804 | A | 9/1996 | Ovortrup et al. | |
| 5,566,683 | A | 10/1996 | Thornton | |
| 5,642,737 | A | 7/1997 | Parks | |
| D382,965 | S | 8/1997 | Wagner | |
| 5,692,523 | A | 12/1997 | Croll et al. | |
| D389,289 | S | 1/1998 | Law | |
| D395,735 | S | 7/1998 | Paramore | |
| 5,819,323 | A | 10/1998 | Edenfield | |
| 5,876,395 | A | 3/1999 | Hart et al. | |
| 5,920,914 | A * | 7/1999 | Dempsey | A41B 9/02 2/400 |
| 5,970,981 | A | 10/1999 | Ochel | |
| 6,023,789 | A | 2/2000 | Wilson et al. | |
| 6,041,441 | A | 3/2000 | Counts et al. | |
| 6,048,327 | A | 4/2000 | Kieffer | |
| 6,058,514 | A | 5/2000 | Hart | |
| 6,061,832 | A | 5/2000 | Morrison, Jr. | |
| 6,068,475 | A | 5/2000 | Stoyka, Jr. | |
| 6,082,363 | A | 7/2000 | Washburn | |
| 6,287,169 | B1 | 9/2001 | Willms et al. | |
| 6,319,219 | B1 | 11/2001 | Landi | |
| D452,011 | S | 12/2001 | Redhage | |
| D453,604 | S | 2/2002 | Hart | |
| D457,690 | S | 5/2002 | Griffiths | |
| 6,405,729 | B1 | 6/2002 | Thornton | |
| 6,430,753 | B2 | 8/2002 | Duran | |
| 6,537,132 | B1 | 3/2003 | Alberts | |
| 6,584,978 | B1 | 7/2003 | Brett et al. | |
| 6,701,533 | B2 | 3/2004 | Webb | |
| 6,918,140 | B1 | 7/2005 | Cooper | |
| 6,978,786 | B2 | 12/2005 | Sabbagh | |
| 6,979,325 | B2 | 12/2005 | Reddy | |
| 7,004,921 | B2 | 2/2006 | Littell | |
| 7,100,213 | B2 | 9/2006 | Krautbauer | |
| D530,863 | S | 10/2006 | Manzo et al. | |
| 7,178,176 | B1 | 2/2007 | S-Cronenbold | |
| D541,481 | S | 4/2007 | Farrell | |
| 7,210,483 | B1 | 5/2007 | Lesniak et al. | |
| 7,216,371 | B2 | 5/2007 | Wong | |
| D548,928 | S | 8/2007 | Wong | |
| 7,296,307 | B2 | 11/2007 | Atwater et al. | |
| 7,299,804 | B2 | 11/2007 | Kittelsen et al. | |
| D572,430 | S | 7/2008 | Wong | |
| 7,658,193 | B2 | 2/2010 | Lesniak | |
| D614,304 | S | 4/2010 | Jansheski | |
| 7,712,156 | B2 | 5/2010 | Raber | |
| 7,757,307 | B2 | 7/2010 | Wong | |
| 7,757,310 | B2 | 7/2010 | Wong | |
| 7,900,285 | B2 | 3/2011 | Steszyn et al. | |
| 7,937,767 | B2 | 5/2011 | Leach et al. | |
| D641,478 | S | 7/2011 | Belvedere et al. | |
| 8,033,392 | B1 | 10/2011 | Gehner et al. | |
| 8,116,854 | B2 | 2/2012 | Hart et al. | |
| D663,485 | S | 7/2012 | Turkbas et al. | |
| D663,486 | S | 7/2012 | Turkbas et al. | |
| 8,235,052 | B2 | 8/2012 | Maurello | |
| 8,336,120 | B2 | 12/2012 | Wong | |
| D688,832 | S | 8/2013 | Polk, III | |
| 8,607,798 | B2 | 12/2013 | Turkbas et al. | |
| 2003/0051288 | A1 | 3/2003 | Dugan | |
| 2003/0163076 | A1 | 8/2003 | Lukens | |
| 2003/0167557 | A1 | 9/2003 | LaShoto et al. | |
| 2003/0205234 | A1 | 11/2003 | Bardach et al. | |
| 2004/0024341 | A1 | 2/2004 | Jacobs | |
| 2005/0050616 | A1 | 3/2005 | Krautbauer | |
| 2005/0204458 | A1 | 9/2005 | Wong | |
| 2005/0268387 | A1 | 12/2005 | Wong | |
| 2005/0278839 | A1 | 12/2005 | Atwater et al. | |
| 2007/0235039 | A1 | 10/2007 | Gottsch | |
| 2008/0058693 | A1 | 3/2008 | Lukens | |
| 2008/0201829 | A1 | 8/2008 | Wang | |
| 2009/0241968 | A1 | 10/2009 | Murphy et al. | |
| 2010/0024105 | A1 | 2/2010 | Sims | |
| 2010/0055233 | A1 | 3/2010 | Macinnis et al. | |
| 2010/0275349 | A1 | 11/2010 | Wilson, II | |
| 2010/0275350 | A1 | 11/2010 | Wong | |
| 2010/0275351 | A1 | 11/2010 | Wong | |
| 2011/0114100 | A1 | 5/2011 | Alvarez et al. | |
| 2011/0186055 | A1 | 8/2011 | Makkar et al. | |
| 2011/0230587 | A1 | 9/2011 | MacInnis et al. | |
| 2012/0085354 | A1 | 4/2012 | Polk, III | |
| 2012/0090625 | A1 | 4/2012 | Evans et al. | |
| 2012/0111343 | A1 | 5/2012 | Turkbas et al. | |
| 2012/0304364 | A1* | 12/2012 | Landi | A41B 9/12 2/403 |
| 2013/0104913 | A1 | 5/2013 | Evans et al. | |
| 2013/0263359 | A1 | 10/2013 | Wong | |

OTHER PUBLICATIONS

International Search Report and Written Opinion issued in PCT/US2014/018755, mailed May 22, 2014, 8 pages.

International Search Report and Written Opinion issued in PCT/US2014/018756, mailed Jun. 3, 2014, 11 pages.

* cited by examiner

CLOTHING ARTICLE WITH PROTECTIVE CUP

CROSS-REFERENCE TO RELATED APPLICATIONS

This application claims priority to Provisional Application No. 61/780,070, filed Mar. 13, 2013 and entitled, "CLOTHING ARTICLE WITH PROTECTIVE CUP," the contents of which are herein incorporated by reference in their entirety.

BACKGROUND

Protective cups and other devices for the protection of the groin region are utilized during athletic competition, as well as for certain non-athletic occupations and activities where users are susceptible to impacts to the groin region.

One conventional method of securing a protective cup against the user's body to protect the groin region from impact is disclosed in U.S. Pat. No. 4,134,400. This device utilizes a jock strap that includes a pouch for holding the protective cup over the groin region. The pouch is closed at one end where it is connected to straps that extend downwardly from the waistband and is open at an upper end where the inner layer of the pouch is connected to the waistband. Fasteners positioned at the opening of the pouch close the pouch to secure the cup in the pouch in position on the body.

Conventional jock straps generally provide only one body gripping aperture, the elastic waistband, to hold the supporter and relatively heavier protective cup in place. For small boys in particular, whose waist and pelvic-hip region are very small, a single body gripping aperture is not enough to hold a supporting device plus protective cup in place. For others, including men who are large around the waist, it may be uncomfortable to have a single tight fitting body aperture around the waist. Additionally, strap twisting may create discomfort and make it difficult to put on the jock strap. Further, while conventional jock straps hold the protective cup generally in place, they tend to be cumbersome and uncomfortable.

An alternative to the jock strap is an athletic support short, which secures a protective cup over the groin region of a user without the use of jock-type straps, and may be comfortably worn as outerwear or under other clothing or equipment. These athletic support shorts may include a releasably closeable pouch to receive a protective cup, such as the shorts reported in U.S. Pat. No. 3,788,314 to Noreen. Although generally more comfortable than conventional jock straps, current athletic short designs may fail to properly secure the protective cup in the most comfortable and protective position over the user's groin, and the protective cup may be become dislodged from its proper positioning when the user moves. Additionally, impact to the genital area may cause the protective cup to be pushed out of position, thereby increasing vulnerability to impact. Further, such movement of the cup may cause the edge of the cup to contact areas of the groin area, potentially causing considerable pain or injury.

U.S. Pat. No. 7,216,371 provides additional jock short solutions, including an integral jock member that has a pocket portion attached to a front of a short member. The assembly includes two elongate members that can help restrict movement of the pocket portion relative to the short member.

SUMMARY

Various embodiments relate to a clothing article with a protective cup, as well as associated systems and methods, for protecting the groin area of a user. The article includes an upper portion having a front and a rear, and an interior and an exterior, for receiving the waist of the user. The article optionally includes a first leg portion and a second leg portion. A cup sleeve having an apical portion is disposed in the interior of the upper portion while partially secured to the front of the upper portion with the apical portion extending free from the front of the upper portion. A securing member optionally extends from the apical portion to the rear of the upper portion.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Some embodiments relate to an article of clothing, or simply "article," including a protective cup for protecting the groin area of a user, as well as associated methods of making or using. In general terms, the article is adapted to hold a protective cup in a cup sleeve adjacent to the groin area of a user, in a more comfortable and/or effective position. For example, in some embodiments, the cup sleeve of the article of clothing has a free apical portion that better allows the cup to extend rearwardly under the groin of the user.

Various planes and associated directions are referenced in the following description, including a sagittal plane defined by two axes, one drawn between a head (superior) and tail (inferior) of the body and one drawn between a back (posterior) and front (anterior) of the body; a coronal plane defined by two axes, one drawn between a center (medial) to side (lateral) of the body and one drawn between a head (superior) and tail (inferior) of the body; and a transverse plane defined by two axes, one drawn between a back and front of the body and one drawing between a center and side of the body.

Figure 1:
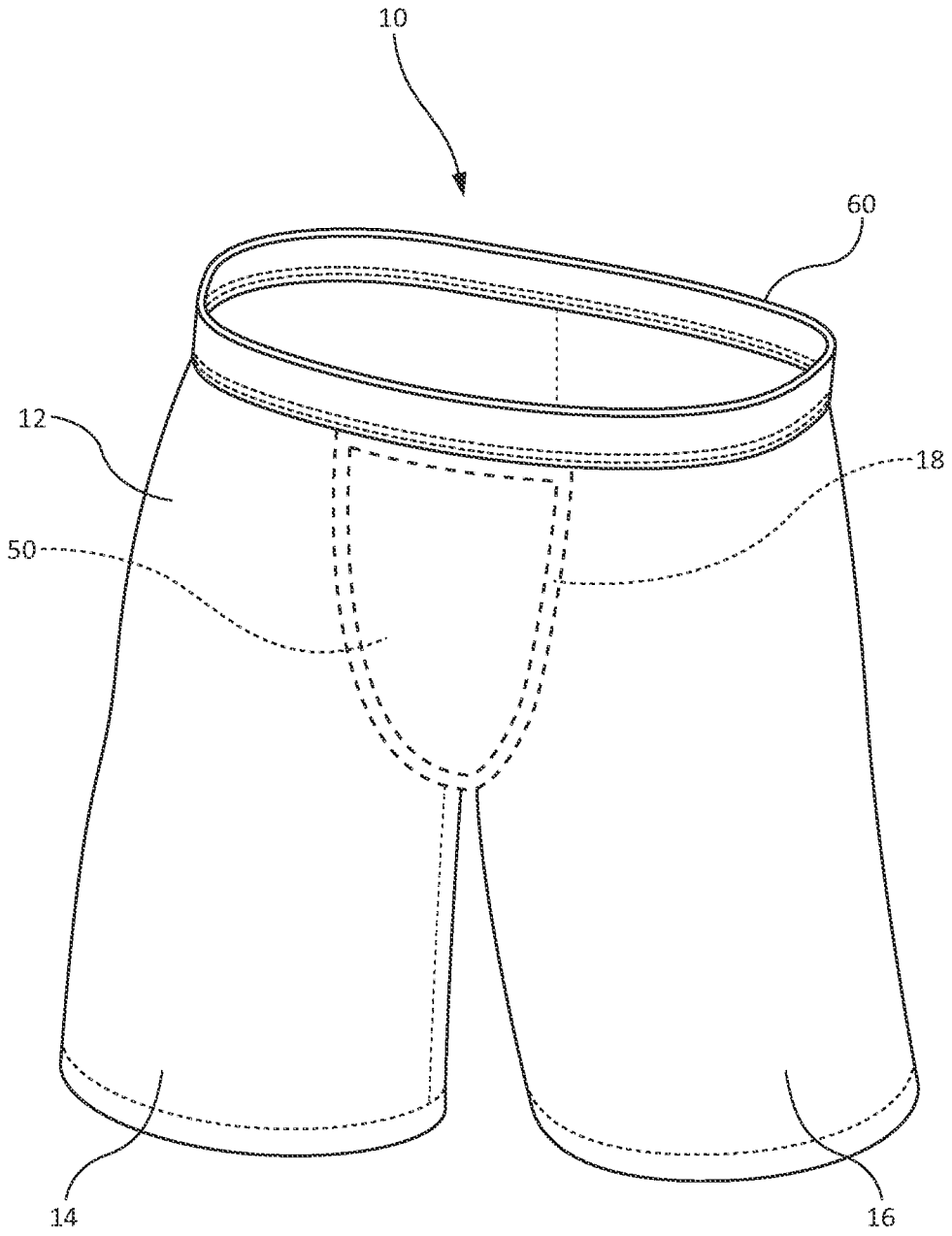
FIG. 1 is a perspective view of an article of clothing, according to some embodiments.

FIG. 1 is a perspective view of an article of clothing 10 for protecting a groin area of a user (not shown), according to some embodiments. As shown, the article 10 is configured in a short format, although a variety of configurations, such as brief, baseball pant, bodysuit, and other sport clothing formats are contemplated. The article 10 can be formed from a variety of materials. In some embodiments, the article 10 is at least partially formed of a compression-type material in order to fit snugly to the user's body. Suitable materials of this type include various mixtures of nylon, polyester, cotton, and spandex. The material may also have moisture wicking capabilities, and/or may be formed partly or completely into a mesh to provide improved ventilation to the user. In some embodiments, panels of material, particularly those forming the cup sleeve 18, are formed from a compressible mesh material. In some alternative embodiments, the article 10 is formed at least partially from a non-compression, loose fitting material, for example, a loose fitting mesh material.

Figure 4:
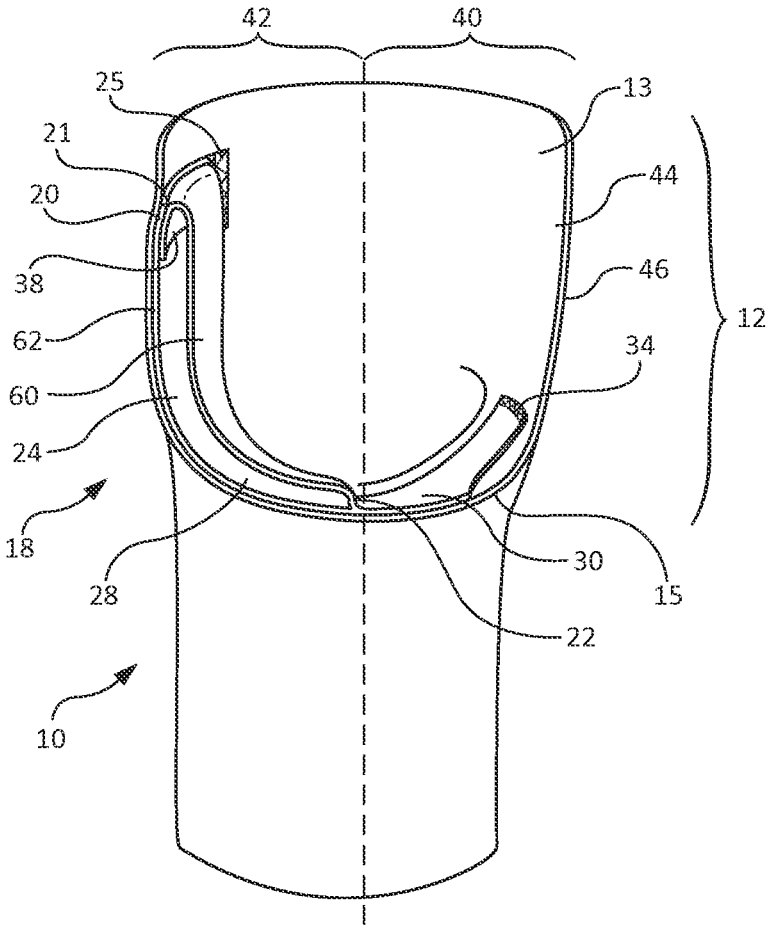
FIG. 4 is a sectional view along line 4-4 of FIG. 2, according to some embodiments.

The article 10 includes an upper portion 12, a cup sleeve 18, and optionally a first leg portion 14 and a second leg portion 16 as shown. The upper portion 12, also described as a trunk portion, is adapted to receive a waist area of the user and includes a top 13 and a bottom 15 (as shown in FIG. 4). The first leg portion 14 and the second leg portion 16, also described as side portions, extend downwardly from the upper portion 12 and are respectively adapted to receive a first and second leg of the user (not shown). The cup sleeve 18, also described as a cup pocket, cup receptacle, cup holder, or any other means adapted to permanently or removably receive a protective cup 50, is disposed in and secured to the upper portion 12. The article 10 may be worn by the user such that the groin area of the user is adjacent to the cup sleeve 18 and the confluence of the upper portion 12, first leg portion 14, and second leg portion 16.

Figure 2:
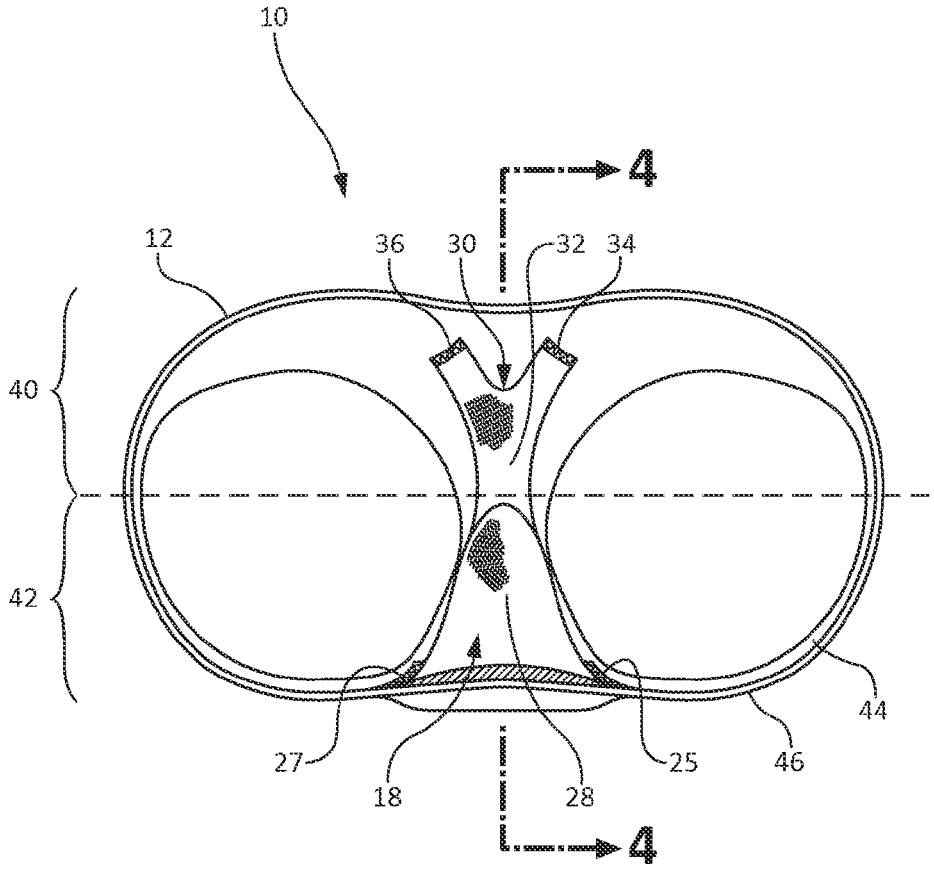
FIG. 2 is a top view of the article of clothing of FIG. 1, according to some embodiments.

FIG. 2 shows a top-down view of the article 10 along the transverse plane of the user, according to some embodiments. As shown, the upper portion 12 includes a rear 40, a front 42, an interior 44, and an exterior 46. Specifically, the cup sleeve 18 is secured within the interior 44 to the front 42 of the upper portion 12 at a first attachment region 25 and a second attachment region 27, permanently or removably. As shown, the article 10 includes a securing member 30 secured to and extending from the cup sleeve 18 is secured within the interior 44 of the article 10 to the rear 40 of the upper portion 12 at a first rear attachment region 34 and a second rear attachment region 36. The first and second rear attachment regions 34, 36 are located closer to the bottom 15 of the upper portion 12 than the top 13 of the upper portion 12 (as shown in FIG. 4).

Figure 3:
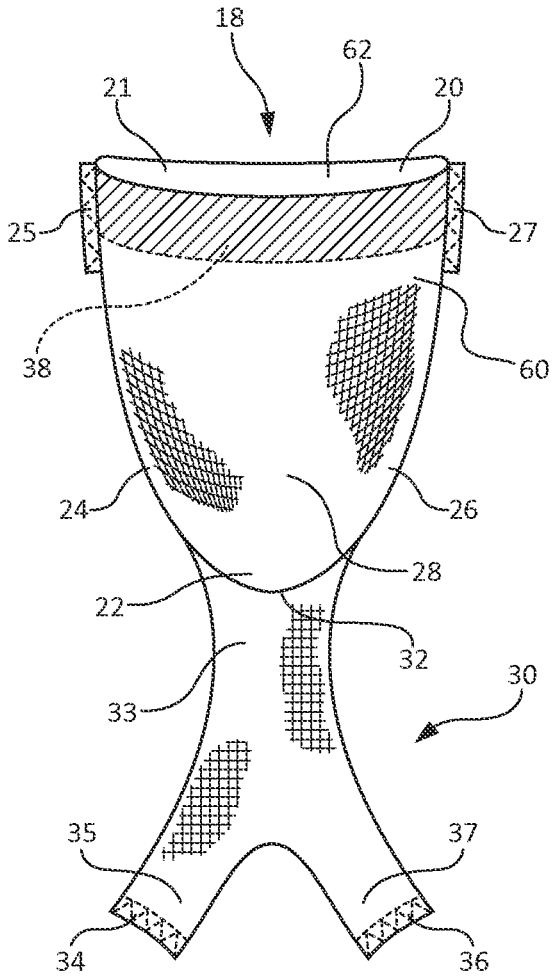
FIG. 3 is an unassembled view of a cup sleeve and a securing member of the article of clothing of FIG. 1, according to some embodiments.
Figure 5:
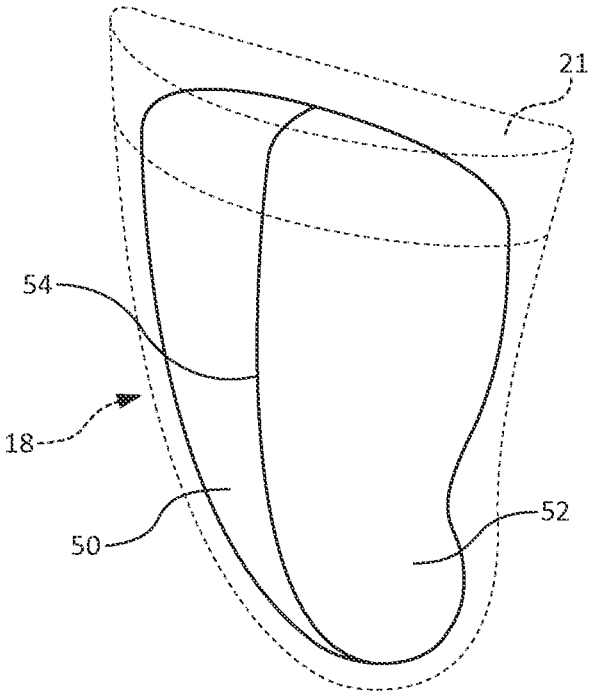
FIG. 5 is a perspective view of a protective cup received in a cup sleeve, according to some embodiments.

FIG. 3 is shows a flattened view of the cup sleeve 18 shown disassembled from the article 10, according to some embodiments. As shown, the cup sleeve 18 has a top 20 defining an opening 21, a bottom 22, a first side 24, a second side 26, and an apical portion 28. The opening 21 is disposed near the top 20 of the cup sleeve and is adapted to receive a protective cup to be held adjacent the groin area. In some embodiments, once received, a flap member 38 is adapted to restrict movement of the protective cup through the opening 21 of the cup sleeve 18. In some embodiments, the flap member 38 includes a releasable fastener to aid in retaining the protective cup, such as hook and loop fasteners sold under the tradename "VELCRO", button fasteners, adhesives, or others. The cup sleeve 18 narrows in width from the top 20 to the bottom 22 to mimic the shape of the protective cup 50 (as shown in FIG. 5) being received such that movement is restricted. The apical portion 28 is located toward the narrow end, or bottom 22, of the cup sleeve 18 and is adapted to receive an apical portion 52 of the protective cup 50 (as shown in FIG. 5).

As shown, the top 20 of the cup sleeve is secured to the front 42 of the upper portion, and the first and second sides 24, 26, also described as edges or seams, of the cup sleeve 18 are partially secured to the interior 44 and front 42 of the upper portion 12 (as shown in FIGS. 2, 4) at the first and second attachment regions 25, 27. The cup sleeve may be secured by stitching along the top 20, first side 24, and second side 26, or by any of a variety of fastening means (e.g., hook and loop fasteners or adhesives) as desired. As shown, about less than 25% of each of the first and second sides 24, 26 is secured to the front 42. As a result, the apical portion 28 of the cup sleeve 18 extends free from the front 42 of the upper portion 12 such that the apical portion 28 is unconstrained by the front 42 of the upper portion 12 and is able to extend more rearwardly under the groin of the user. According to various embodiments, this feature helps promote extension of the apical portion 52 of the protective cup 50 under the groin of the user.

As shown, the securing member 30 is attached to the apical portion 28 of the cup sleeve 18, permanently or removably by any of a variety of fastening means. The securing member 30 is configured to restrict movement of the apical portion 28 to stabilize the cup sleeve 18 relative to the groin area of the user. In some embodiments, as shown, the securing member 30 is "Y"-shaped, including a front extension 33, a first rear extension 35 and a second rear extension 37, and is formed of elastic or any other variety materials or combination thereof. In some embodiments, the cup sleeve 18 is formed of a neoprene material, for example. The front extension 33 of the securing member 30 attaches to the apical portion 28 of the cup sleeve 18 at apical attachment region 32 and the first and second rear extensions 35, 37 of the securing member 30 attaches to the rear 40 of the upper portion 12 at the first and second rear attachment regions 34,36. With the securing member 30 in place, the apical portion 52 of the protective cup 50 is optimally held adjacent to the groin area of the user. The relatively low position of the rear attachment region 34, 36 (e.g., in an area proximate the lower buttocks of the user) promotes extension of the apical portion 52 of the protective cup 50 in a rearward direction that helps provide effective protective positioning with a comfortable fit under a user's groin area. In other embodiments, the securing member 30 attaches to the front 42 of the upper portion 12.

FIG. 4 shows a cutaway view of the article 10, along the sagittal plane of the user and along line 4-4 shown in FIG. 2, according to some embodiments. As shown, the cup sleeve 18 is disposed in the interior of the upper portion 12 and the first side 24 is partially secured at a first attachment region 25. For example, as shown, about 25% of the sides of the cup sleeve 18. In some embodiments, about 5% or more to about less than 25% of the sides of the cup sleeve 18 are secured. In some embodiments, about 25% or more to about less than 50% of the sides of the cup sleeve 18 are secured. In some embodiments, about 50% or more to about less than 75% of the sides of the cup sleeve 18 are secured. In some embodiments, about 75% or more to about less than 95% of the sides of the cup sleeve 18 are secured.

The opening 21 of the cup sleeve 18 is disposed near the top 20 of the cup sleeve 18 and is adapted to receive a protective cup 50 (as shown in FIG. 5) and a flap member 38 is adapted to restrict movement of the received protective cup 50. The apical portion 28 of the cup sleeve is shown extending free from the front 42 of the upper portion. The apical portion 28 attaches to the securing member 30 at apical attachment region 22. The securing member 30 is further attached to the rear 40 of the upper portion 12 at the rear attachment region 34, which is located closer to the bottom 15 of the upper portion 12 than the top 13 of the upper portion 12, for example in an area of the article 10 corresponding to the lower buttocks of the user. As a result, the groin area of the user is fully protected by the protective cup 50 even when movement of the user's legs causes the first and second leg portions 14, 16 of the article 10 to move.

FIG. 5 shows a perspective view of protective cup 50 with an apical portion 52, which has been received in the cup sleeve 18 through opening 21. Line 54 represents an imaginary line running down the front of the cup is to better illustrate the perspective view. The cup sleeve 18 is configured to receive a variety of suitable protective cups 50. For example, the protective cup 50 can comprise a single rigid or semi-rigid piece or multiple such pieces. An illustrative example of a protective cup 50 can be found in U.S. Pat. No. 7,757,310, titled "IMPACT PROTECTION DEVICE," which is incorporated herein by reference in its entirety for all purposes.

Figure 6:
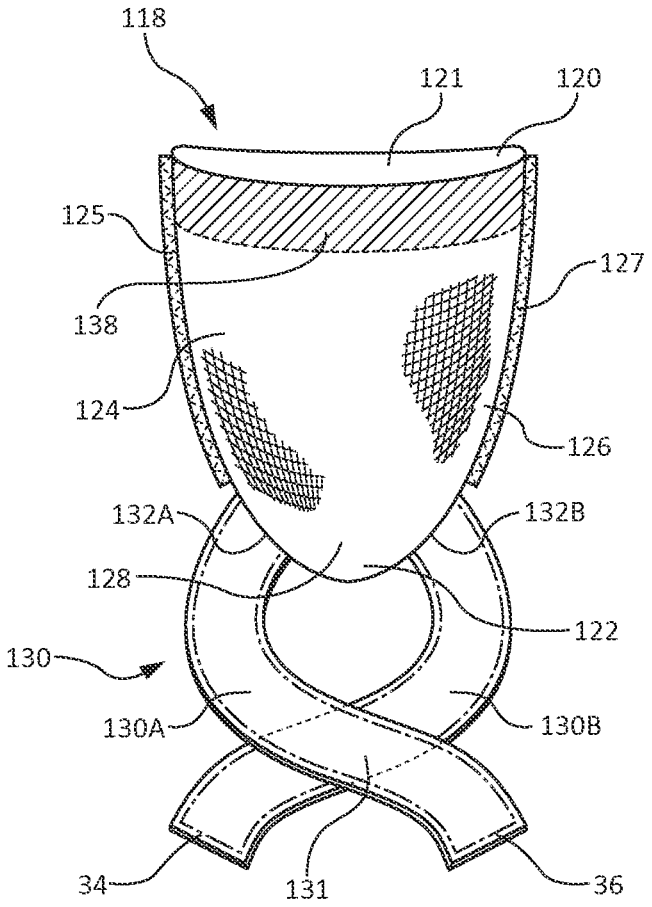
FIG. 6 is an unassembled view of a cup sleeve and a securing member of the article of clothing of FIG. 1, according to some alternative embodiments.

FIG. 6 shows a flattened view of a cup sleeve 118 and a securing member 130 detached from the article 10, according to some alternative embodiments. The cup sleeve 118 and the securing member 130 are optionally employed with the article 10 as an alternative to the cup sleeve 18 and securing member 30. As shown, the cup sleeve 118 includes a top 120 defining an opening 121, a bottom 122, a first side 124, a second side 126, and an apical portion 128. The top 120 of the cup sleeve 118 is secured to the front 42 of the upper portion 12, and the first and second sides 124, 126 of the cup sleeve 118 are partially secured to the front 42 of the upper portion 12 at the attachment regions 125, 127. In some embodiments, 75% or more of the first and second sides 124, 126 are secured to the front 42 of the upper portion 12. The apical portion 128 extends free from the front 42 of the upper portion 12.

As shown, the securing member 130 extending from the apical portion 128 comprises two straps 130*a* and 130*b*, which overlap at intersection 131 forming an "X"-shape. Strap 130*a* is secured to the apical portion 128 at apical attachment region 132*a* and to the rear 40 of the upper portion 12 at rear attachment region 36 of the article 10. Strap 130*b* is secured to the apical portion 128 at apical attachment region 132*b* and to the rear 40 of the upper portion 12 at rear attachment region 34 of the article 10.

Figure 7:
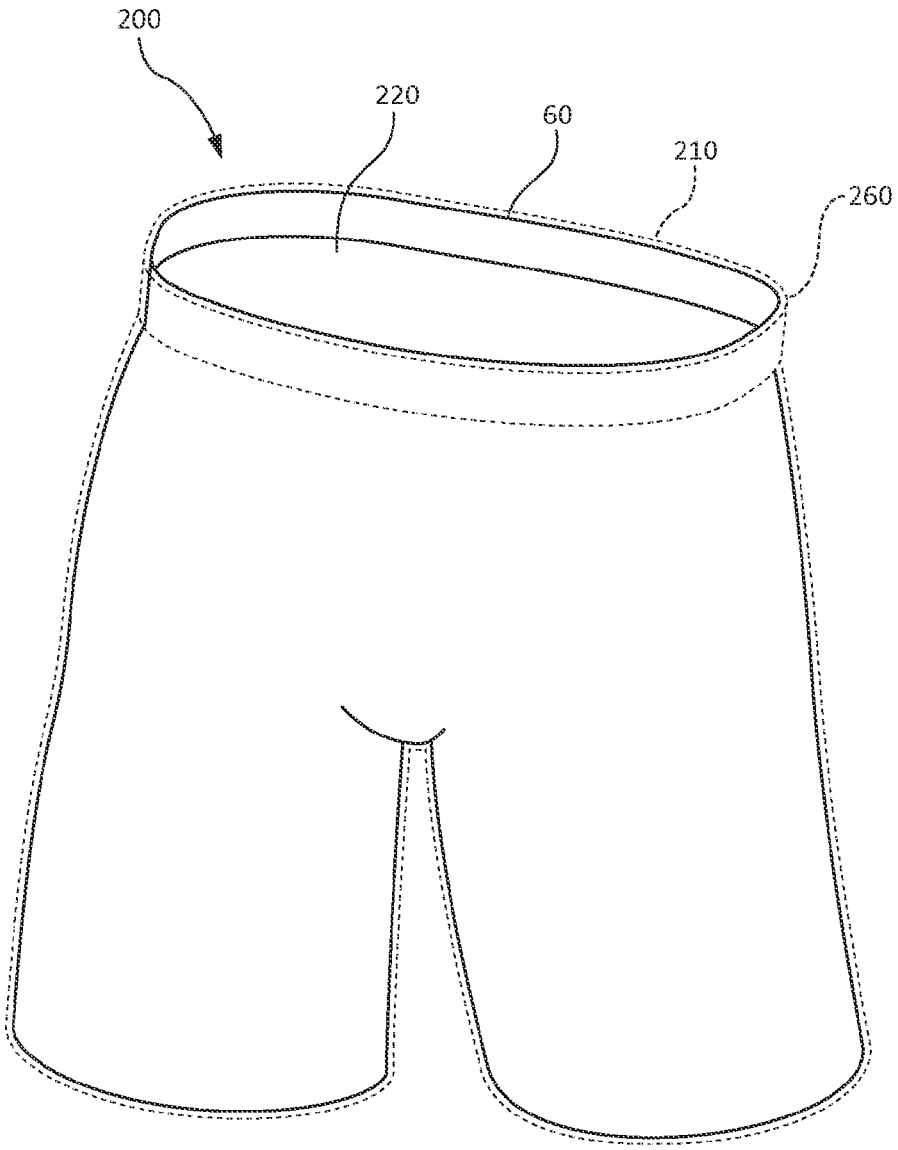
FIG. 7 is a perspective view of an article of clothing including inner and outer shells, according to some embodiments.

FIG. 7 shows an article 200 including the article 10 configured as an inner article 220, similar to the article of clothing 10, disposed within an outer article 210. In some embodiments, for example, the outer article 210 is an external short. However, the outer article 210 can be any article of clothing designed to be worn by the user. In some embodiments, the outer article 210 is secured to the article 220, permanently or removably. For example, in some embodiments, the articles are secured by any of a variety of fastening means, partially or entirely, along the waist areas 60 and 260 (e.g. waistlines) of each of the inner and outer articles 220 and 210, respectively. For example, the articles may be secured by hook and loop fastener material, such as VELCRO, or may be secured by sewn thread. In some embodiments, the articles are secured at areas other than the waistline.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. An article of clothing for wear by a user comprising:

an upper portion having a front and a rear, a first side and a second side, and an interior and an exterior and configured to receive a waist of the user;

a first leg portion extending downwardly from the upper portion and configured to receive a first leg of the user;

a second leg portion extending downwardly from the upper portion and configured to receive a second leg of the user;

a cup sleeve disposed in the interior of the upper portion, the cup sleeve having a first side defining a first edge, a second side defining a second edge, a top, and a bottom, and narrowing in width from the top to the bottom to form an apex, the first and second sides of the cup sleeve being secured to the front of the upper portion within the interior of the upper portion along a portion of the first edge and a portion of the second edge such that an apical portion of the cup sleeve extends free from the front of the upper portion, and a securing member extending from the apical portion of the cup sleeve, the securing member comprises a first strap and a second strap overlapping the first strap at an intersection such that the first and second straps form an X-shape, each of the first and second straps having a first end attached to the bottom of the cup sleeve and a second end attached to the interior of the upper portion at the rear of the upper portion, the securing member configured to restrict movement of the apical portion of the cup sleeve relative to the groin area of the user.

2. The article of claim 1, wherein the cup sleeve forms an opening near the top of the cup sleeve to receive a protective cup between the cup sleeve and front of the upper portion.

3. The article of claim 2, wherein the cup sleeve includes a flap member adapted to restrict movement of the received protective cup.

4. The article of claim 1, wherein from about 5% or more to about less than 25% of each of the first and second sides of the cup sleeve is secured to the upper portion.

5. The article of claim 1, wherein from about 25% or more to about less than 50% of each of the first and second sides of the cup sleeve is secured to the upper portion.

6. The article of claim 1, wherein from about 50% or more to about less than 75% of each of the first and second sides of the cup sleeve is secured to the upper portion.

7. The article of claim 1, wherein from about 75% or more to about less than 95% of each of the first and second sides of the cup sleeve is secured to the upper portion.

8. The article of claim 1, wherein the securing member extends from the apical portion of the cup sleeve to the rear of the upper portion and is configured to be located between the legs of the user when worn and hold a protective cup adjacent to the groin of the user.

9. The article of claim 8, wherein the securing member attaches to the upper portion closer to the bottom of the upper portion than to the top of the upper portion.

10. The article of claim 1, wherein an outer portion attaches to and is disposed on the exterior of the upper portion.

11. A method of making an article of clothing for wear by a user comprising:

providing an upper portion having a front and a rear, a first side and a second side, and an interior and an exterior and configured to receive a waist of the user;

providing a first leg portion extending downwardly from the upper portion and configured to receive a first leg of the user;

providing a second leg portion extending downwardly from the upper portion and configured to receive a second leg of the user;

providing a cup sleeve disposed in the interior of the upper portion, the cup sleeve having a first side defining a first seam, a second side defining a second seam, a top, and a bottom, and narrowing in width from the top to the bottom to form an apex;

attaching the cup sleeve to the front of the upper portion such that an apical portion of the cup sleeve extends free from the front of the upper portion, wherein attaching the cup sleeve includes attaching at least a portion of the length of the first seam and at least a portion of the length of the second seam of the cup sleeve to the front and interior of the upper portion and at least partially securing the top of the cup sleeve to the front and interior of the upper portion; and attaching a securing member between the cup sleeve and the rear of the upper portion, such that the securing member extends from the apical portion of the cup sleeve to the rear of the upper portion, the securing member comprising a first strap and a second strap overlapping the first strap at an intersection such that the first and second straps form an X-shape, each of the first and second straps having a first end attached to the bottom of the cup sleeve and a second end attached to the interior of the upper portion at the rear of the upper portion, the securing member configured to restrict movement of the apical portion of the cup sleeve relative to the groin area of the user.

12. An article of clothing for wear by a user comprising:

an upper portion having a front and a rear, a first side and a second side, and an interior and an exterior and configured to receive a waist of the user, the upper portion including a waist area;

a cup sleeve disposed in the interior of the upper portion, the cup sleeve having a top, and a bottom, and narrowing in width from the top to the bottom to form an apex, a first side defining a first edge and a second side defining a second edge extending downwardly from the top to the bottom, the top of the cup sleeve being at least partially secured to the front of the upper portion within the interior of the upper portion and at least a portion of the first edge and second edge secured to the front of the upper portion within the interior of the upper portion such that an apical portion of the cup sleeve extends free from the front of the upper portion; and a securing member extending from the apical portion of the cup sleeve, the securing member comprises a first strap and a second strap overlapping the first strap at an intersection such that the first and second straps form an X-shape, each of the first and second straps having a first end attached to the bottom of the cup sleeve and a second end attached to the interior of the upper portion at the rear of the upper portion, the securing member configured to restrict movement of the apical portion of the cup sleeve relative to the groin area of the user.

13. The article of claim 12, wherein the securing member attaches to the upper portion closer to the bottom of the upper portion than to the top of the upper portion.

14. The article of claim 12, wherein an outer portion attaches to and is disposed on the exterior of the upper portion.

* * * * *